US007931262B2

(12) United States Patent
Ochi et al.

(10) Patent No.: US 7,931,262 B2
(45) Date of Patent: Apr. 26, 2011

(54) IMAGE FORMING SYSTEM INCLUDING FINISHER WITH STAPLER FOR BINDING PRINTED PAPERS

(75) Inventors: Makoto Ochi, Osaka (JP); Yoshiteru Nishikawa, Osaka (JP); Kozo Tao, Osaka (JP)

(73) Assignee: Kyoceramita Corporation, Osaka (JP)

( * ) Notice: Subject to any disclaimer, the term of this patent is extended or adjusted under 35 U.S.C. 154(b) by 521 days.

(21) Appl. No.: 11/627,283

(22) Filed: Jan. 25, 2007

(65) Prior Publication Data

US 2007/0176346 A1 Aug. 2, 2007

(30) Foreign Application Priority Data

Jan. 27, 2006 (JP) ..... 2006-019843
Jan. 27, 2006 (JP) ..... 2006-019844
Jan. 27, 2006 (JP) ..... 2006-019845

(51) Int. Cl.
*B65H 37/04* (2006.01)

(52) U.S. Cl. ..... 270/58.09; 270/37; 270/52.18; 270/58.07; 270/58.08

(58) Field of Classification Search ..... 270/37, 270/52.18, 58.07, 58.08, 58.09
See application file for complete search history.

(56) References Cited

U.S. PATENT DOCUMENTS

| | | | | |
|---|---|---|---|---|
| 4,878,656 | A * | 11/1989 | Honjo et al. | 270/58.09 |
| 5,032,876 | A * | 7/1991 | Murakami | 399/410 |
| 5,078,376 | A * | 1/1992 | Yamada et al. | 270/58.09 |
| 5,140,380 | A * | 8/1992 | Nakamura et al. | 399/408 |
| 5,832,358 | A * | 11/1998 | Sampath et al. | 399/405 |
| 6,088,568 | A | 7/2000 | Ohtani | |
| 6,229,984 | B1 | 5/2001 | Ohtani | |
| 7,410,156 | B2 * | 8/2008 | Ikeda et al. | 270/37 |
| 2004/0256783 | A1 * | 12/2004 | Iida et al. | 270/58.08 |

FOREIGN PATENT DOCUMENTS

| | | | |
|---|---|---|---|
| JP | 03063192 | A | 3/1991 |
| JP | 08272160 | A | 10/1996 |
| JP | 2723987 | | 11/1997 |
| JP | 10236720 | A | 9/1998 |
| JP | 2002316764 | A * | 10/2002 |
| JP | 2005001266 | A | 1/2005 |

* cited by examiner

*Primary Examiner* — Leslie A Nicholson, III
(74) *Attorney, Agent, or Firm* — Hogan Lovells US LLP

(57) ABSTRACT

In an image forming device, images of originals up to an upper limit number of stapling are read (S1 to S5) and image data thereof are processed (S6 to S8). If a paper sensor has detected a subsequent original even when the number of pages of the read images reaches NS0 (S1, S2), a finisher discharges a bundle of printed papers without stapling. Consequently, the number of the printed papers included in the discharged bundle is made less than the upper limit number. In a case where the number of the printed papers sent to the finisher (S12, S13) is less than a set number NS1 (S15), the bundle is discharged without being stapled after the number of the printed papers reaches NS1 (S17).

3 Claims, 11 Drawing Sheets

IMAGE FORMING SYSTEM INCLUDING FINISHER WITH STAPLER FOR BINDING PRINTED PAPERS

BACKGROUND OF THE INVENTION

1. Field of the Invention

The present invention relates to an image forming system, more particularly, to an image forming system comprising a finisher which stacks printed or copied papers to staple them.

2. Description of the Related Art

Generally, a finisher is used in combination with a printer or a copier. The printer or the copier discharges printed or copied papers sheet by sheet. When receiving the discharged papers, the finisher stacks them in sequence at one place. Then, the finisher staples a bundle of a certain number of the stacked papers.

There is an upper limit to the number of papers that the finisher can staple. Even if the finisher receives copies discharged from the printer or the copier after having already received the upper limit number of copies, the finisher can no longer bind them. In this state, the finisher has to discharge the copies, which have been already received and bundled for stapling, without stapling them. When the finisher discharges a bundle of the copies at a time, these copies easily scatter because they are not stapled. This causes the occurrence of a jam in the finisher, so that subsequent printing or copying is stagnated.

SUMMARY OF THE INVENTION

The present invention disclosed and claimed herein, in one aspect thereof, comprises an image forming system. The image forming system comprises: an image forming device which processes image data in a unit of page, and prints, on a paper, an image formed based on the processed image data, to discharge the printed paper; and a finisher which, in a case where stapling of a plurality of printed papers is requested in a print job given to the image forming device, holds the discharged printed papers on a stacker and staples a bundle of the printed papers held on the stacker to discharge the stapled bundle to a tray. Further, the system stores a value of an upper limit number of printed papers that are staplable in the finisher. The system comprises a controller. In a case where the stapling in the finisher is requested in the print job given to the image forming device, the controller counts the number of pages of processed image data, and when determining that a pre-stage count value which is a value of the counted number of pages exceeds the upper limit number, the controller performs control in which the bundle held on the stacker is discharged to the tray without being stapled in the finisher, before the number of the printed papers held on the stacker reaches the upper limit number.

Further scope of applicability of the present invention will become apparent from the detailed description given hereinafter. The detailed description and embodiments are only given as examples though showing preferred embodiments of the present invention, and therefore, from the contents of the following detailed description, changes and modifications of various kinds within the spirits and scope of the invention will become apparent to those skilled in the art.

BRIEF DESCRIPTION OF THE DRAWINGS

The present invention will be fully understood from the following detailed description and the accompanying drawings. The accompanying drawings only show examples and are not intended to restrict the present invention. In the accompanying drawings.

DETAILED DESCRIPTION

Figure 1:
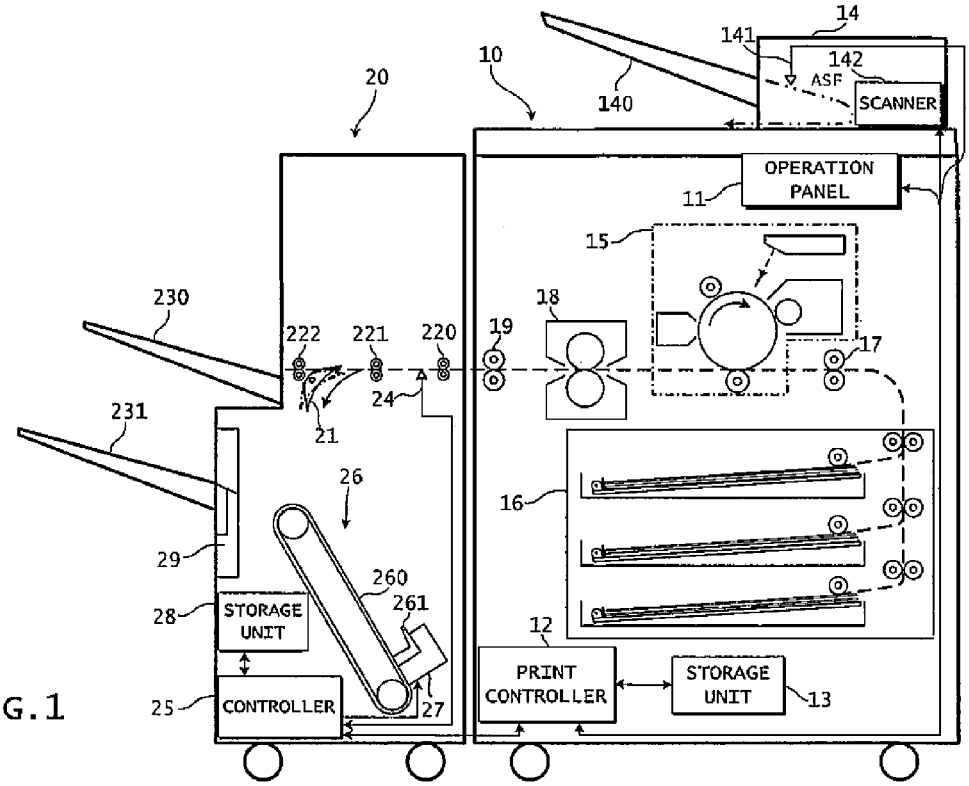
FIG. 1 is a view schematically showing the structure of an image forming system.

FIG. 1 schematically shows the structure of an image forming system. This system comprises, for example, a copier 10 and a finisher 20. The system operates in a state where the finisher 20 is adjacently coupled to the copier 10. The copier 10 may be a multifunction device. The multifunction device has not only a function as a copier but also functions of a fax machine, a network printer, a network scanner, and so on.

The copier 10 is provided with a print controller 12. The finisher 20 is provided with another controller 25. Each of these controllers 12, 25 is constituted of, for example, an electronic circuit including a central processing unit. The circuits are built in the copier 10 and the finisher 20 respectively, each being formed on a circuit board. Further, storage units 13, 28 are connected to the controllers 12, 25 respectively. These storage units 13, 28 have memories and/or hard disk drives.

Data that a user sets by operating an operation panel 11 when using the copier 10 are processed by the print controller 12 and are stored in the storage unit 13. This setting includes the size, type, and feeding direction of a paper, copy density, frame erase, binding margins, processing for integrating a plurality of pages on one page (so-called "2-in-1" and "4-in-1"), and so on. The print controller 12 executes image processing according to these settings. The time taken for the controller 12 to execute the image processing depends on the contents of the settings. An application program for multi-threaded processing is stored in the storage unit 13.

For example, in image processing involving the copying of originals, when a user places the originals on a tray 140 of an auto sheet feeder 14 and presses a start key (not shown) of the operation panel 11, the controller 12 executes the following processing in response to this operation. First, in a case where a paper sensor 141 detects the originals, the controller 12 causes the ASF 14 to feed the originals sheet by sheet and causes a scanner 142 to scan images of the originals in the course of the feeding. The print controller 12 turns the images scanned by the scanner 142 to data and stores the image data in the storage unit 13 in a unit of one job.

After performing pre-processing such as noise filtering on the image data, the print controller 12 performs the image processing according to the settings of various kinds to supply the processed data to a print engine 15 page by page. Consequently, an electrostatic latent image is formed on a surface of a photosensitive drum of the print engine 15, and the electrostatic latent image is developed with a toner.

Meanwhile, inside the copier 10, a paper taken out from a paper feeder 16 is fed to a resist roller 17 and is tentatively stopped here. When the photosensitive drum of the print engine 15 rotates to reach a predetermined angle, the paper is sent out by the resist roller 17 at this timing. Consequently, a toner image is transferred to the paper from a surface of the photosensitive drum. This paper passes through a fusing unit 18 to be heated and pressed, so that the toner image is fixed on the paper. The paper on which the toner image is transferred is discharged via a discharge roller 19 to be delivered to the finisher 20.

The user can select staple processing when using the copier 10. The user can select the staple processing through the operation panel 11. The staple processing is executed by the finisher 20 after the copying. In the staple processing, copied papers are bundled to be stapled in the finisher 20.

The finisher 20 has therein a rocker 21. The rocker 21 is switched between two positions. In a case where the user selects the staple processing when using the copier 10, the rocker 21 is switched to the position shown by the solid line in FIG. 1, and otherwise, it is switched to the position shown by the chain double-dashed line in FIG. 1.

In a case where the staple processing is not selected, copies sent by a carrier roller 221 pass above the rocker 21 to pass through a discharge roller 222, and then are discharged onto a tray 230. A paper sensor 24 is provided between the carrier roller 220 close to an entrance of the finisher 20 and the carrier roller 221 in the back thereof. When detecting that a rear end of each of the copies passes thereabove, the paper sensor 24 outputs a detection signal indicating the passage. The signal outputted by the paper sensor 24 is supplied to the controller 25.

In the case where the staple processing is selected, the copies sent out from the discharge roller 19 pass through the carrier roller 220 and then through the carrier roller 221, and thereafter, are guided by the rocker 21 to move downward, and soon reach a stacker 26.

The stacker 26 has a belt conveyor 260 in an inclined posture. On a belt thereof a stopper 261 is attached. The copies guided by the rocker 21 are stacked on the belt. The stopper 261 holds a lower end portion of a bundle of the copies stacked on the belt. The lower end portion of the bundle of the copies held by the stacker 26 is bound by a stapler 27.

After the stapler 27 normally binds the bundle of the copies, the belt conveyor 260 raises the bundle to discharge the bundle onto a tray 231. The tray 231 is moved up/down by a lift device 29. The lift device 29 moves down the tray 231 according to the type and the number of papers discharged on the tray 231, that is, according to the thickness of the discharged bundle.

The image forming system performs the following operations of a plurality of kinds in addition to the above-described basic operation.

FIRST EXAMPLE

An upper limit number NS0 of the staple processing and a set number NS1 are stored in the storage unit 28. Concrete values of the upper limit number NS0 and the set number NS1 are determined in advance according to the type and size of papers. In particular, the upper limit number NS0 is determined based on the capacity of the stopper 261. Further, the set number NS1 is such a value that a bundle of copies in this number is assumed not to cause a jam when discharged from the stacker 26 to the tray 231 without being stapled, and this value is smaller than the upper limit number NS0. For example, in a case where the type of a paper used for copying is "plain paper" and the size thereof is B4, the upper limit number NS0 is set to 30 in advance. The set number NS1 corresponding thereto is 20. Alternatively, in a case where the type of a paper is "plain paper" and the size thereof is A4, the upper limit number NS0 is set to 50 in advance. The set number NS1 corresponding thereto is 30. The set number NS1 also depends on an inclination angle of the conveyor belt 260 and its carriage speed.

The upper limit number NS0 is used by the print controller 12 for its own processing. However, the value of the upper limit number NS0 differs depending on each type of the finisher 20 which can be combined with the copier 10, and therefore, the upper limit number NS0 corresponding to the type of each finisher 20 is stored in a nonvolatile memory area (ROM or a hard disk) of the storage unit 28. In initialization processing upon power-on of the copier 10, the controller 25 reads the value of the upper limit number NS0 from the storage unit 28 to notify the read value to the print controller 12. The print controller 12 stores the notified value of the upper limit number NS0 in a RAM of the storage unit 13.

Incidentally, in a case where the finishers 20 which can be combined with the copier 10 are only of one type, or in a case where only one type is designated in advance as the finisher 20 which is to be combined with the copier 10, the upper limit number NS0 may be stored in the ROM or the hard disk of the storage unit 13 in advance.

Figure 2:
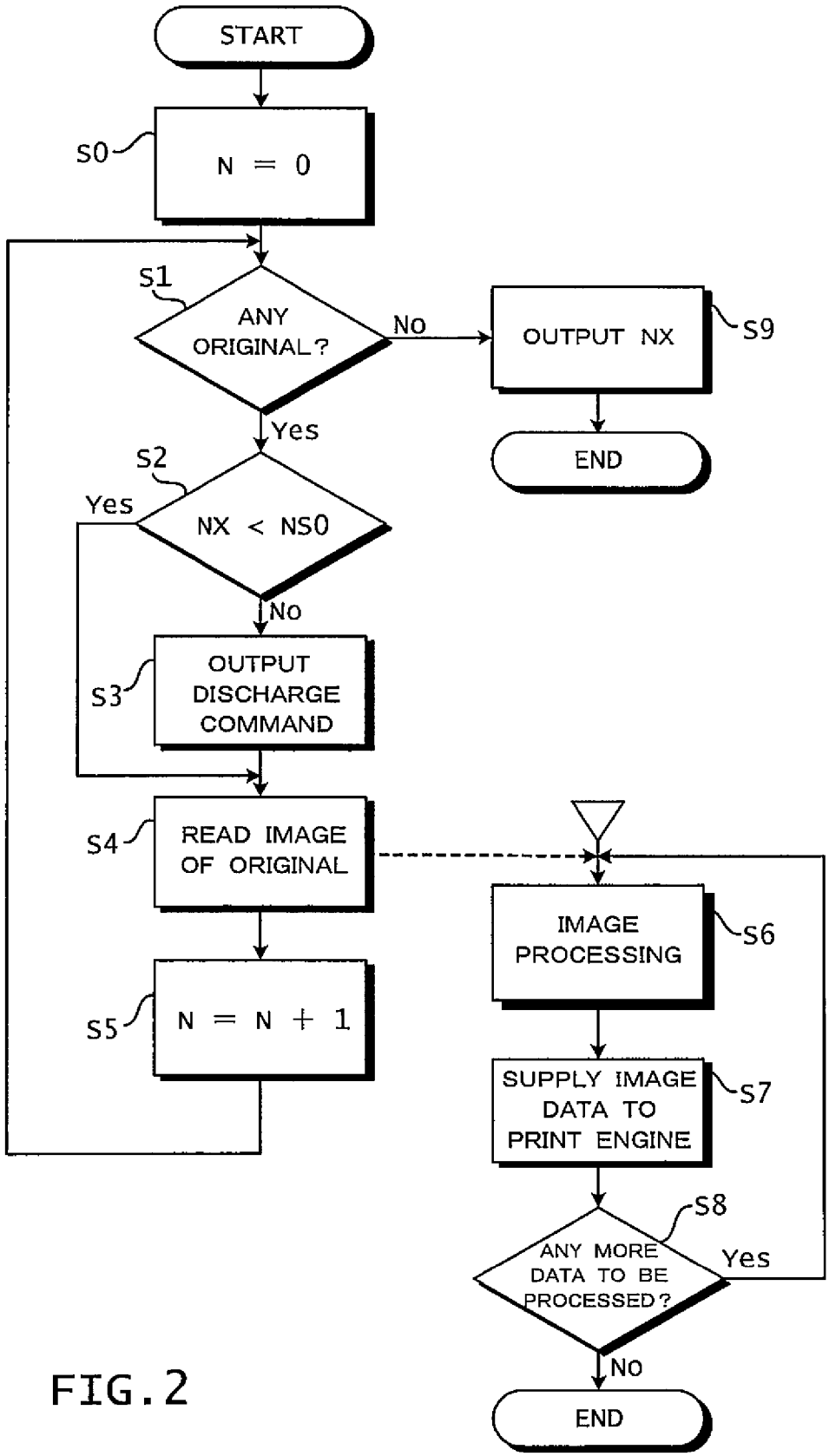
FIG. 2 is a flowchart showing copy processing of a first example.

Next, copy processing by the print controller 12 will be described. This processing is executed in a case where the auto sheet feeder 14 is used to feed originals and a user selects the staple processing. FIG. 2 is a flowchart showing this processing. This processing is started when the user presses the start key of the operation panel 11. In the following, the parenthesized symbols are step identification symbols.

(S0) An initial value 0 is substituted in a count N of the number of originals.

(S1) If the paper sensor 141 has detected an original, the flow goes to Step S2, and if not, the flow goes to Step S9.

(S2) If a value of a count NX of the number of image formed papers is equal to the upper limit number NS0, the flow goes to Step S3, and if not, the flow goes to Step S4. In a usual case, the count NX is equal to the count N. As an exception, for example, in 4-in-1 integration processing, $NX=[(N-1)/4]+1$. Here, [ ] is an operator for rounding down decimal places of the operation result of the mathematical expression therein to give an integer. In a case where NX=NS0, it is determined that NX>NS0 since it is determined at Step S1 that an original exists.

(S3) A command for discharging a bundle of copies is supplied to the controller 25. However, in a case where the image formation by the print engine 15 or the carriage of a paper having a transferred toner image is underway in the copier 10, the command is supplied to the controller 25 after this paper is discharged from the copier 10. The controller 25 responds to the command by interruption processing to set a discharge flag F in the storage unit 28. The image formation by the print engine 15 is resumed after a signal transmitted from the controller 25 and indicating the completion of the discharge of the bundle of the copies becomes active.

Alternative processing at Step S3 may be such that the command is immediately supplied to the controller 25, and the controller 25 receiving the command executes the command not immediately but after a predetermined time passes from the receipt of the command.

(S4) The ASF 14 is operated to feed one sheet of the original, and the scanner 142 scans an image thereof. Then, image data from the scanner 142 is tentatively stored in the storage unit 28.

If N=1, in order to execute processing at Step S6 and processing at Step S7 in parallel with other processing, the controller 12 generates threads of the processing at Step S6 and the processing at Step S7 to execute these threads.

(S5) N is incremented by 1 and the flow returns to Step S1.

(S6) The controller 12 executes the image processing previously described, in a unit of page, on the image data stored in the storage unit 28 at Step S4, and stores the processed image data in the storage unit 13.

When the image processing of the first page is completed, in order to execute processing at Step S8 and processing at Step S9 in parallel with other processing, the controller 12 generates threads of the processing at Step S8 and the processing at Step S9 to execute the threads.

(S7) The processed image data corresponding to one page stored in the storage unit 13 is supplied to the print engine 15.

(S8) If there is any more data to be processed, the flow returns to Step S6, and if not, the threads of Steps S6 and S7 are finished.

(S9) A value of the count NX of the number of image formed papers is supplied to the controller 25. The controller 25 responds thereto by interruption processing and substitutes the value of NX in the total number of image formed papers Nm stored in the storage unit 28. Nm corresponds to the number of pages of image data which have been processed so far.

In a case where the staple processing is selected, when completing the processing at Step S7 for the first page, the print controller 12 supplies a start command to the controller 25. In response to the start command, the controller 25 starts processing shown in FIG. 3.

(S10) Since the total number of image formed papers Nm in one copy job is unknown, an arbitrary value Nmax which is larger than the number of papers on which images are formable, for example, 1000 is substituted in Nm. This total number of image formed papers Nm is updated later at Step S9.

(S11) An initial value 0 is substituted in a count i of the number of stacked papers.

(S12) The detection of a rear end of a paper by the paper sensor 24 is waited for.

(S13) i is incremented by 1.

(S14) If i=Nm, the flow goes to Step S19, and if not, the flow goes to Step S15.

(S15) If i=NS1, the flow goes to Step S16, and if not, the flow returns to Step S12.

(S16) If the discharge flag F is set, the flow goes to Step S17, and if not, the flow returns to Step S12.

(S17) After a set time passes, the belt conveyor 260 is driven to raise the bundle of the copies and the copies are discharged onto the tray 231. Then, the lift device 29 is driven to move down the tray 231 according to the thickness of the bundle of the copies. The aforesaid set time is a time long enough for a copy carried in from the copier 20 to reach the stacker 26 and to be surely held there.

(S18) The number of remaining copies (Nm−i) is substituted in Nm, and the flow returns to Step S11.

(S19) If the discharge flag F is set, the flow goes to Step S21, and if not, the flow goes to Step S20.

(S20) After a set time passes, the bundle of the copies held by the stacker 26 is bound by the stapler 27. The set time here is a time long enough for a copy to reach the stacker 26 after the rear end of the copy is detected by the sensor 24 and to be surely held there.

(S21) The belt conveyor 260 is driven to raise the bundle of the copies and the bundle is discharged onto the tray 231. Further, the lift device 29 is driven to move down the tray 231 according to the thickness of the bundle.

Figure 4A:
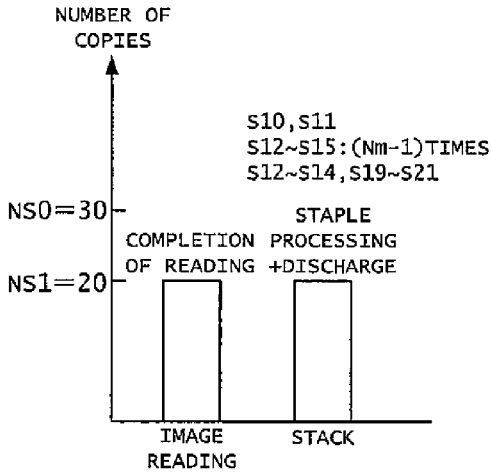
FIG. 4A and FIG. 4B are graphs showing concrete examples in a case where a total number of image formed papers Nm≦an upper limit number NS0 and staple processing is executed.
Figure 4B:
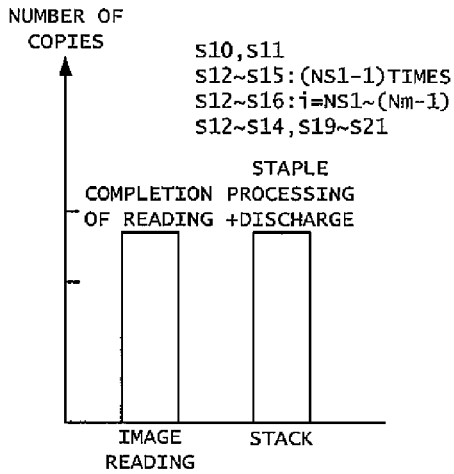
Figure 4C:
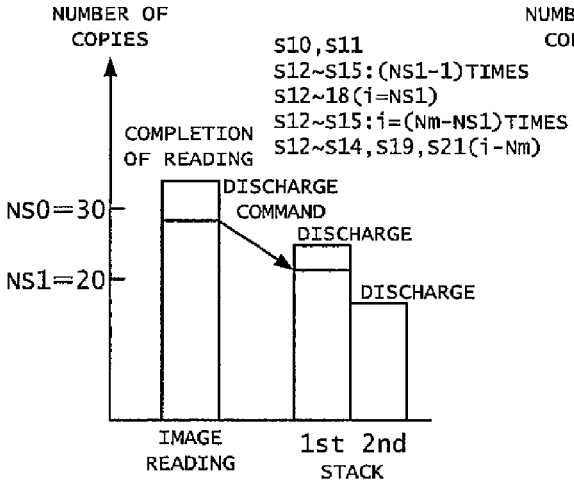
FIG. 4C and FIG. 4D are graphs showing concrete examples in a case where Nm>NS0 and the staple processing is not executed.
Figure 4D:
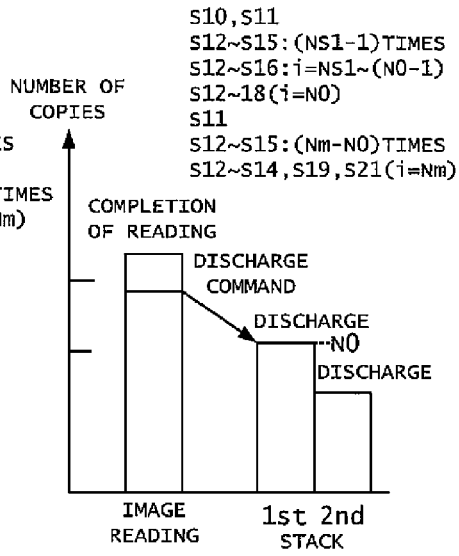

FIG. 4A to FIG. 4D show concrete examples of the above-described processing in a case where the staple processing is selected. FIG. 4A and FIG. 4B both show cases where Nm≦NS0 and the staple processing is executed. FIG. 4C and FIG. 4D both show cases where Nm>NS0 and the staple processing is not executed.

Figure 3:
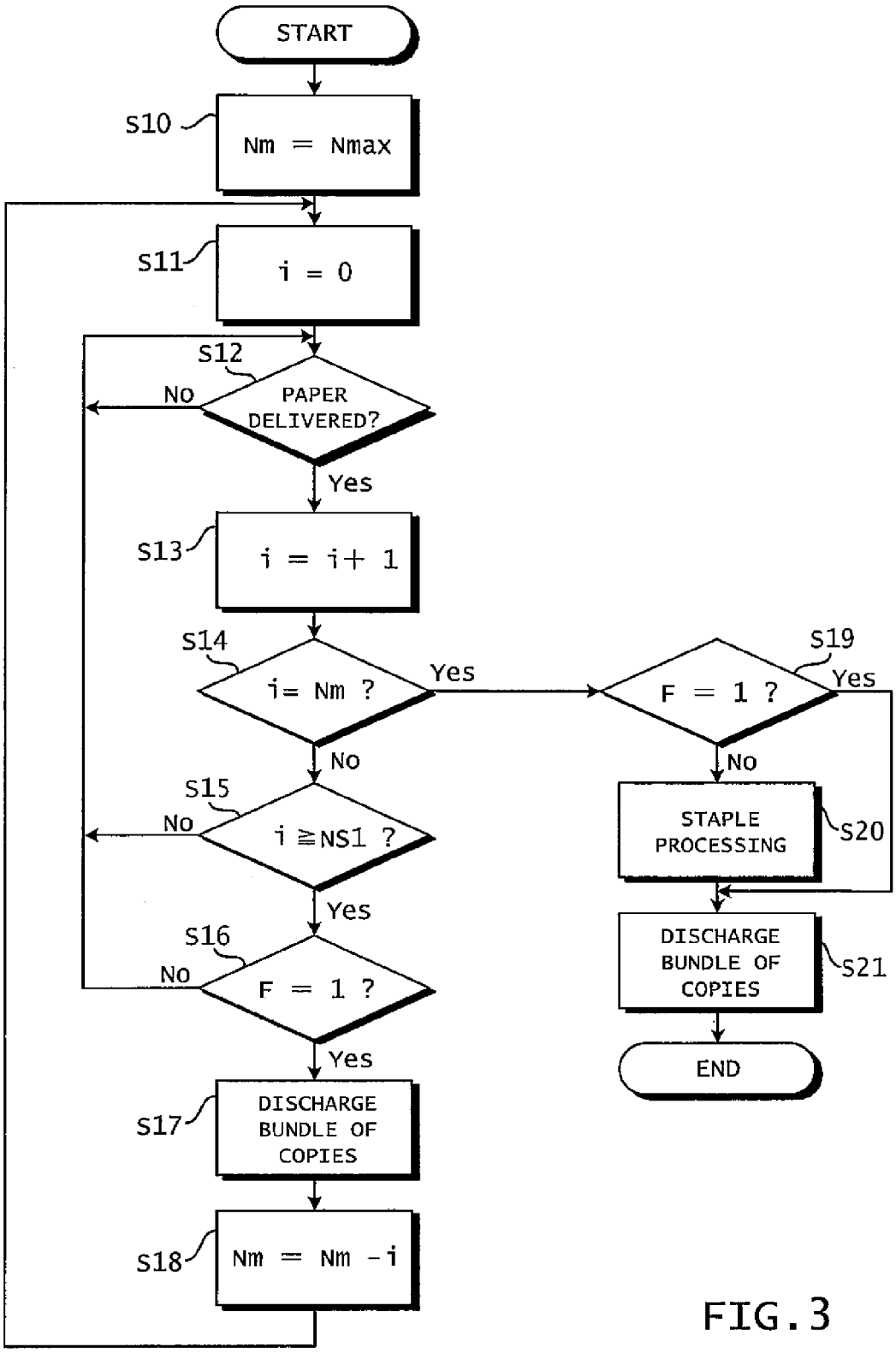
FIG. 3 is a flowchart showing processing executed by a controller of a finisher according to the copy processing of the first example.

FIG. 4A shows a case where Nm<NS1, and in this case, the processing in FIG. 3 is executed in the following sequence.

(1) S10 and S11 are executed.

(2) S12 to S15 are repeatedly executed (Nm−1) times.

(3) S12 to S14 and S19 to S21 are executed.

FIG. 4B shows a case where NS1<Nm<NS0, and in this case, the processing in FIG. 3 is executed in the following sequence.

(1) S10 and S11 are executed.

(2) S12 to S15 are repeatedly executed (NS1−1) times.

(3) S12 to S16 are executed for i=NS1 to (Nm−1).

(4) S12 to S14 and S19 to S21 are executed.

FIG. 4C shows a case where NS0<Nm<2NS1 and the controller 12 of the copier 10 determines that Nm>NS0 before NS1 sheets of copies are stacked on the stacker 26. In this case, the processing in FIG. 3 is executed in the following sequence.

(1) S10 and S11 are executed.

(2) S12 to S15 are repeatedly executed (NS1−1) times.

(3) S12 to S18 are executed for i=NS1: A bundle of NS1 sheets of copies is discharged without being stapled.

(4) S12 to S15 are repeatedly executed (Nm−NS1) times.

(5) S12 to S14, S19, and S21 are executed for i=Nm: A bundle of remaining NS1 sheets of copies or less is discharged without being stapled.

FIG. 4D shows a case where NS0<Nm<2NS1 and it is determined in the copier 10 that Nm>NS0 in a state where N0 sheets (NS1<N0<NS0) of copies are stacked on the stacker 26. In this case, the processing in FIG. 3 is executed in the following sequence.

(1) S10 and S11 are executed.

(2) S12 to S15 are repeatedly executed (NS1−1) times.

(3) S12 to S16 are executed for i=NS1 to (N0−1).

(4) S12 to S18 are executed for i=N0: A bundle of N0 sheets of copies is discharged without being stapled.

(5) S11 is executed.

(6) S12 to S15 are repeatedly executed (Nm−N0) times.

(7) S12 to S14, S19, and S21 are executed for i=Nm: A bundle of the remaining NS1 sheets of copies or less is discharged without being stapled.

Figure 5:
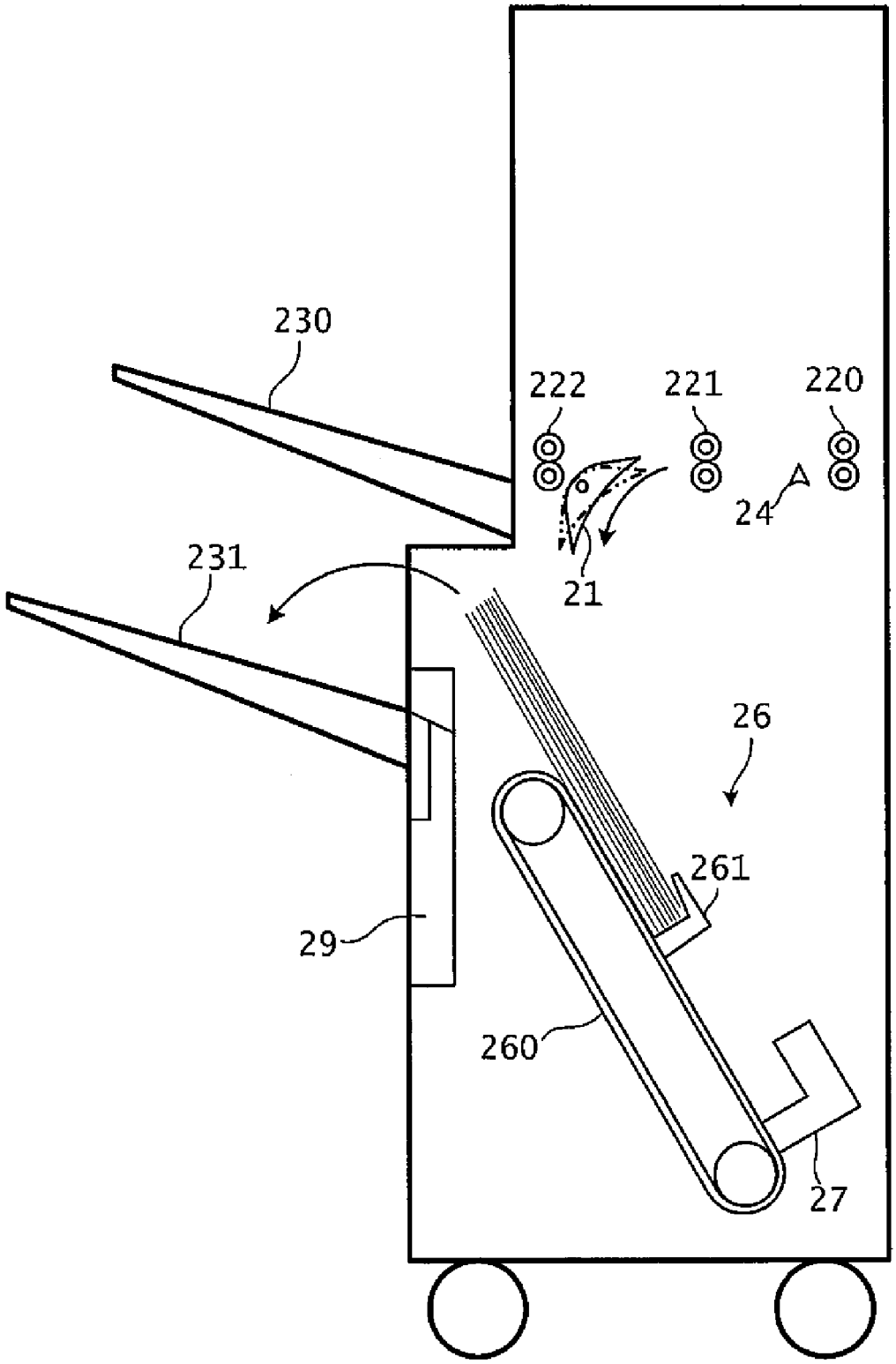
FIG. 5 is a view showing the operation when the finisher discharges a bundle of copies.

FIG. 5 shows the operation when the belt conveyor 260 in the finisher 20 discharges a bundle of copies onto the tray 231. Conventionally, after copies corresponding to the upper limit number NS0 are actually stacked into a bundle, these copies are discharged without being stapled. Therefore, as compared with the case of the discharge operation executed in the first example, the number of the copies in the bundle is larger, which accordingly tends to cause a jam.

On the other hand, according to the above-described first example, in a case where original images are read up to the upper limit number NS0 and a subsequent original is detected by the paper sensor 141 in the copier 10, it is determined at Step S2 that NX exceeds the upper limit number NS0. In this case, the discharge command is supplied from the print controller 12 to the controller 25, and in response to the discharge command, the controller 25 discharges a bundle of copies held on the stacker 26 without performing staple processing, so that the number of the copies in the bundle becomes (NS0−1) or less. This can bring about an effect of further reducing an incidence of a jam than ever when a bundle of copies is discharged from the stacker 26 to the tray 231 and contributes to improvement of reliability of the image forming system. In addition, owing to this effect, the upper limit number of the staple processing can be increased than ever.

Further, in a case where the auto sheet feeder 14 is capable of high-speed feeding and/or the image processing is performed in a short time, in some cases, the number of delivered copies counted by the controller 25 has not reached the set number NS1 at the time when the discharge command is supplied from the print controller 12 to the controller 25. In this case, after the counted number of copies reaches the set number NS1, a bundle of the copies held on the stacker 26 is discharged without being stapled, which hardly causes the occurrence of a jam.

The above-described first example can be modified as follows.

For example, the positions of Step S5 and Step S2 in the flowchart in FIG. 2 are arbitrary, and may be inserted in a loop of Steps S6 and S7 or in a loop of Steps S8 and S9. However, in a case where such a modification is made, it is as a matter of course that N should be used instead of the aforesaid NX when the number of pages N after the integration processing such as 4-in-1 is counted.

Further, since the print controller 12 and the controller 25 are coupled so as to be capable of mutual information transmission, the upper limit number NS0 and the set number NS1 only need to be stored in one of the storage unit 28 and the storage unit 13.

SECOND EXAMPLE

Figure 6:
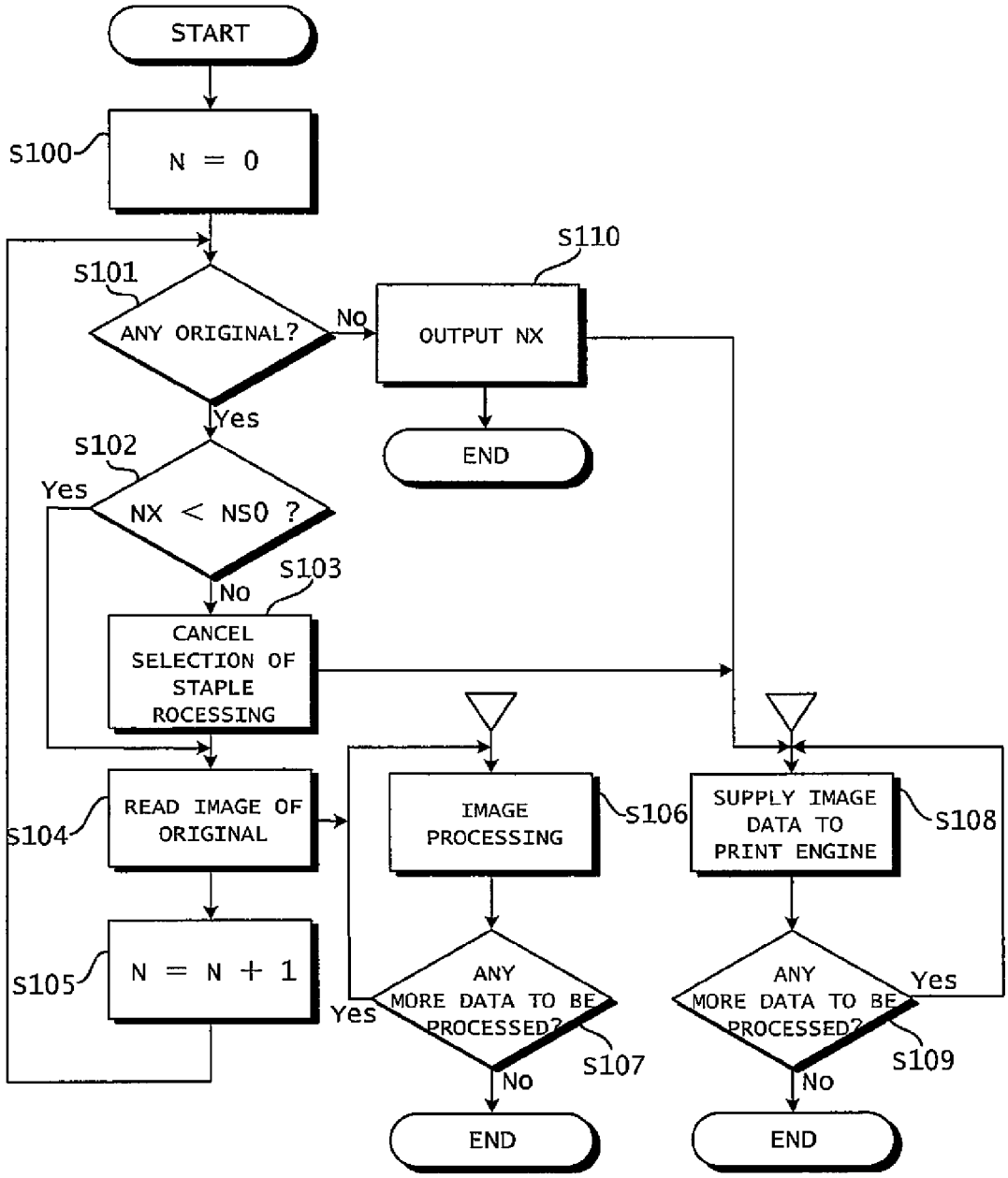
FIG. 6 is a flowchart showing copy processing of a second example.

Next, copy processing of a second example will be described. FIG. 6 is a flowchart showing this processing. This processing is started when the start key of the panel 11 is pressed.

(S100) An initial value 0 is substituted in the count N of the number of originals.

(S101) If the paper sensor 141 has detected an original, the flow goes to Step S102, and if not, the flow goes to Step S110.

(S102) If the count NX of image formed papers is equal to the upper limit number NS0, the flow goes to Step S103, and if not, the flow goes to Step S104. In a usual case, the count NX is equal to the count N, but as in the above-described first example, NX=[(N−1)/4]+1 in the 4-in-1 integration processing. Also in the second example, in a case where NX=NS0, it is determined as NX>NS0 since the existence of an original has been determined at Step S100.

(S103) Staple processing which has been selected is cancelled and this is notified to the controller 25. In response to this notification, the controller 25 changes the position of the rocker 21. Further, in order to execute processing at Step S108 and processing at S109 in parallel with other processing, the controller 12 generates threads of the processing at Step S108 and the processing at Step 109 and executes these threads to cause the print engine 15 to start the image forming processing.

(S104) The ASF 14 is operated to feed one sheet of the originals, and the scanner 142 scans an image thereof. Then, image data from the scanner 142 is tentatively stored in the storage unit 28.

If N=1, in order to execute processing at Step S106 and processing at Step S107 in parallel with other processing, the controller 12 generates threads of the processing at Step S106 and the processing at Step S107 to execute these threads (S105) N is incremented by 1 and the flow returns to Step S101.

(S106) The controller 12 executes the image processing previously described, in a unit of page, on the image data stored in the storage unit 28 at Step S104, and stores the processed image data in the storage unit 13.

(S107) If there is any more data to be processed, the flow returns to Step S106, and if not, the threads of Steps S106 and S107 are finished.

(S108) The processed image data corresponding to one page, which is stored in the storage unit 13, is supplied to the print engine 15.

(S109) If there is any more data to be supplied, the flow returns to Step S108, and if not, the threads of Steps S108 and S109 are finished.

(S110) If the selected staple processing has not been cancelled, a value of the count NX of the number of image formed papers is supplied to the controller 25 as the total number of image formed papers Nm. Based on this Nm, the controller 25 determines that the delivery of the copies to the stacker 26 has been finished.

If the threads of Steps S108 and S109 are not generated at Step S103 described above, the controller 12 generates the threads and executes the threads to cause the print engine 15 to start the image forming processing.

In a case where the staple processing is selected, the controller 12 supplies a start command to the controller 25 upon completing the processing for the first page at Step S108. In response to the start command, the controller 25 starts processing that should be executed by itself. That is, the controller 25 starts counting, by the paper sensor 24, the copies sent to the stacker 26. When the count value reaches Nm, the controller 25 binds, by the stapler 27, a bundle of the copies at its rear end portion, and raises the bundle of the copies by the belt conveyor 260 to discharge the bundle of the copies onto the tray 231.

Figure 7A:
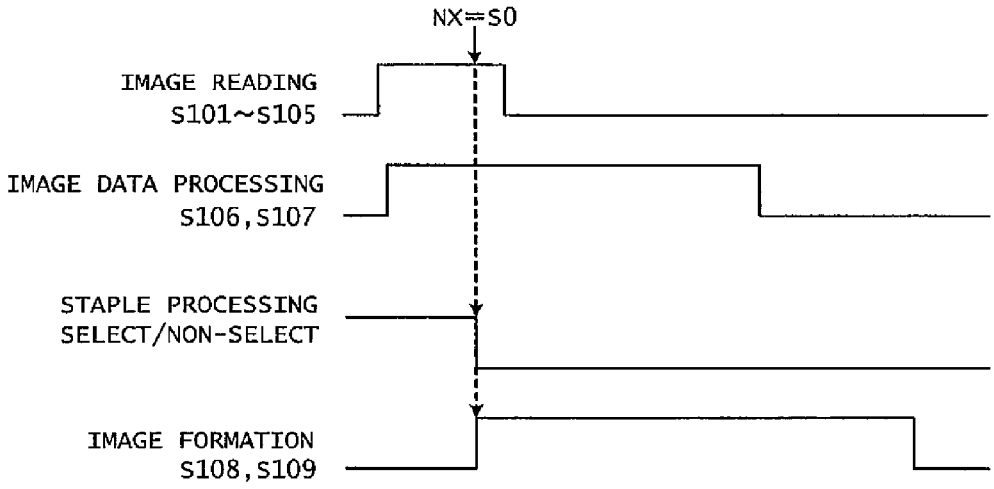
FIG. 7A and FIG. 7B are time charts showing concrete examples of the copy processing in a case where the staple processing is selected prior to the start of a job.
Figure 7B:
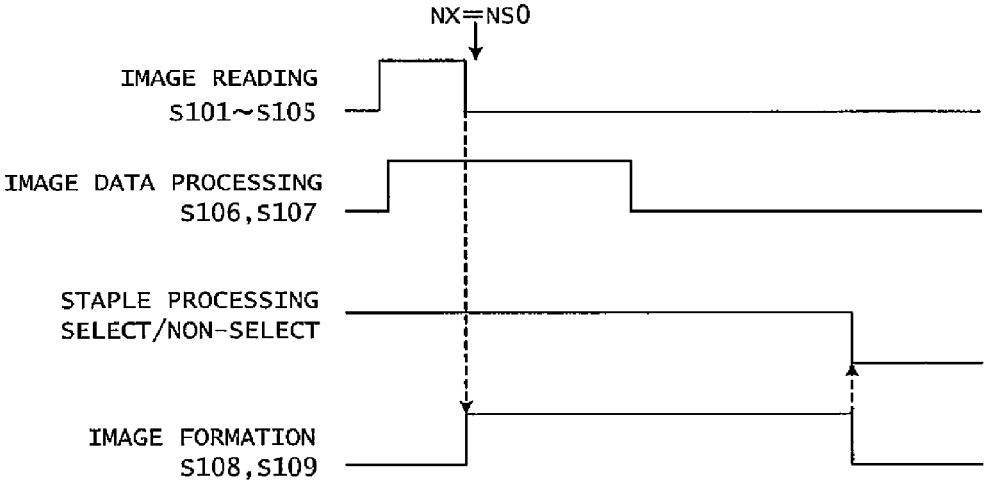

FIG. 7A and FIG. 7B are time charts showing concrete examples of the above-described processing in a case where the staple processing is selected prior to the start of a job. FIG. 7A shows a case where Nm>NS0 and the staple processing is cancelled when NX=NS0. FIG. 7B shows a case where Nm<NS0 and the staple processing is executed. In the case of FIG. 7A, Step S108 is started at Step S103. In the case of FIG. 7B, Step S108 is started at Step S110.

According to the above-described second example, in a case where original images are read up to the upper limit number NS0 and a subsequent original is detected by the paper sensor 141 in the copier 10, it is determined at Step S102 that NX exceeds the upper limit number NS0. In this case, the controller 12 cancels the staple processing (S103) and also starts supplying the print engine 15 with the processed image data stored in the storage unit 13. Therefore, the copies are not carried to the stacker 26 but are discharged onto the tray 230 from the discharge roller 222, which brings about an effect of preventing the occurrence of a jam ascribable to the discharge of a bundle of the copies via the stacker 26 and contributes to improvement of reliability of the image forming system. Further, owing to this effect, the upper limit number of the staple processing can be increased than ever.

Conventionally, even if the number of copies exceeds the upper limit number, a bundle of remaining copies has to be discharged through the stacker 26 if the staple processing is selected. In this case, since the remaining copies cannot be carried to the stacker 26 while the belt conveyor 260 is in the course of the operation of discharging a bundle of the copies corresponding to the upper limit number, it is necessary to suspend the image forming/discharge processing until this operation is finished. According to the operation example 2, such suspension is not required, and the image forming processing can be executed continuously without any pause.

Incidentally, in the operation example 2, it is not possible, either, to execute the image forming processing of a current job before N=NS. However, during this period, it is possible to execute the image forming processing of another job by the parallel processing. Further, in a case where the time taken to process image data corresponding to one page is longer than the time taken to form an image corresponding to one page, since processed image data corresponding to NS0 pages are stored in the storage unit 13, the image forming processing can be continued by using these data.

The above-described second example can be modified as follows.

For example, the positions of Step S105 and Step S102 in the flowchart in FIG. 6 are arbitrary, and these steps may be inserted in a loop of Steps S106 and S107 or in a loop of Steps S108 and S109. However, in a case where such a modification is made, it is a matter of course that N should be used instead of the aforesaid NX when the number of pages N after integration processing such as 4-in-1 is counted.

Further, as described in the first example, since the print controller 12 and the controller 25 are coupled to each other so as to be capable of mutual information transmission, the upper limit number NS0 only need to be stored in one of the storage unit 28 and the storage unit 13.

THIRD EXAMPLE

Figure 8:
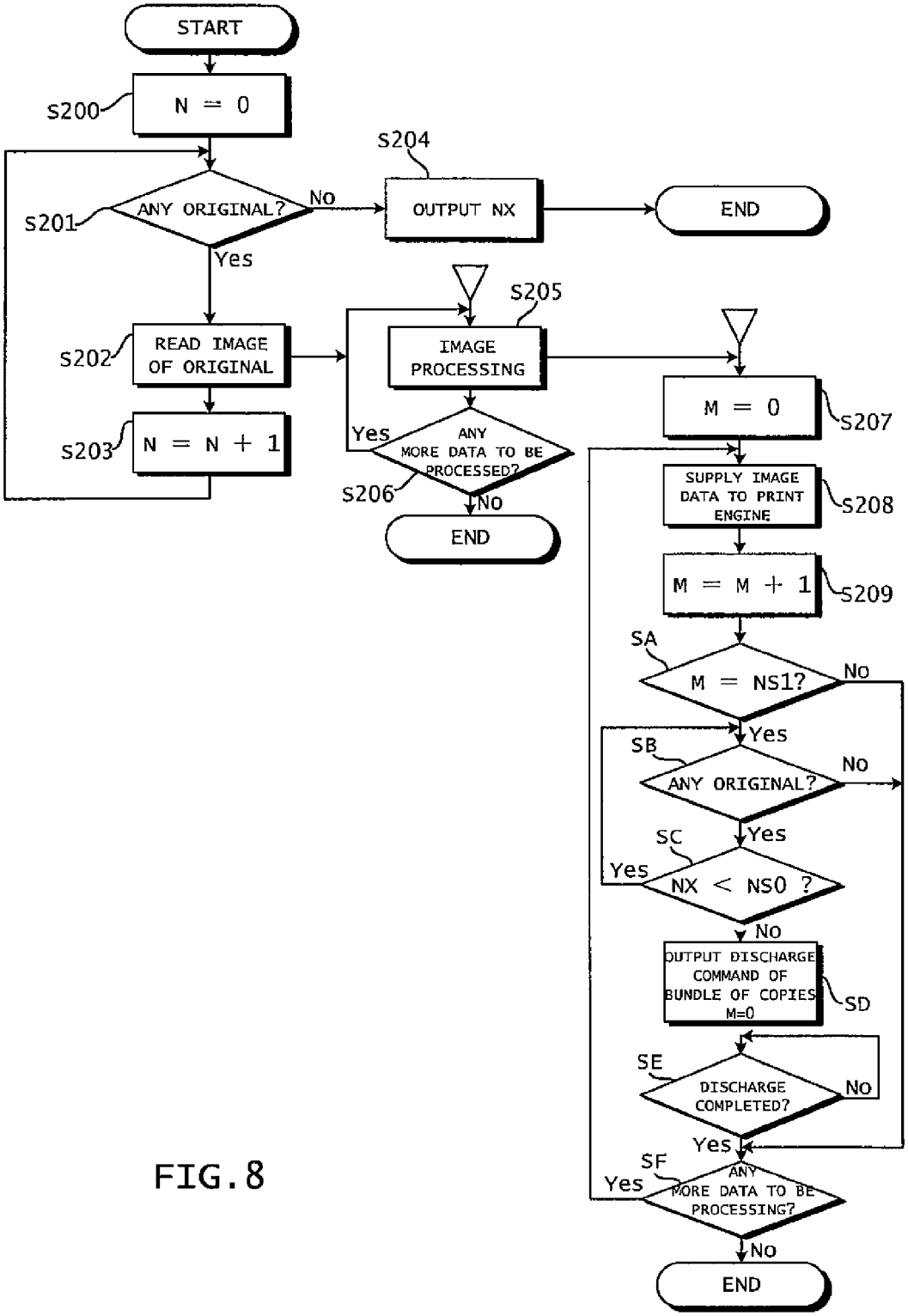
FIG. 8 is a flowchart showing copy processing of a third example.

Next, copy processing of a third example will be described. FIG. 8 is a flowchart showing this processing. This processing is started when the start key of the panel 11 is pressed.

(S200) An initial value 0 is substituted in the count N of the number of originals.

(S201) If the paper sensor 141 has detected an original, the flow goes to Step S202, and if not, the flow goes to Step S204.

(S202) The ASF 14 is operated to feed one sheet of the original, and the scanner 142 scans an image thereof. Then, image data from the scanner 142 is tentatively stored in the storage unit 28.

If N=1, in order to execute processing at Step S205 and processing at Step S206 in parallel with other processing, the controller 12 generates threads of the processing at Step S205 and the processing at Step S206 to execute these threads.

(S203) N is incremented by 1 and the flow returns to Step S201.

(S204) A value of the count NX of the number of image formed papers is supplied to the controller 25. In a usual case, the count NX is equal to the count N of the number of originals, but as in the above-described first example, NX=[(N−1)/4]+1 in the 4-in-1 integration processing.

The controller 25 executes interruption processing in response to the receipt of this NX and substitutes the value of this NX in the total number of image formed papers Nm stored in the storage unit 28.

(S205) The image processing previously described is executed, in a unit of page, on the image data which are stored in the storage unit 28 at Step S202, and the processed image data are stored in the storage unit 13.

When the image processing of the first page is completed, in order to execute processing at Steps 207 to S209 and SA to SF in parallel with other processing, the controller 12 generates threads of the processing at Steps S207 to S209 and SA to SF and executes these threads.

(S206) If there is any more data to be processed, the flow returns to Step S205, and if not, the threads of Steps S205 and S206 are finished.

(S207) An initial value 0 is substituted in a count M of the number of pages whose processed image data have been supplied to the print engine 15.

(S208) The processed image data corresponding to only one page stored in the storage unit 13 is supplied to the print engine 15.

(S209) The count M is incremented by 1.

(SA) When the supply of image data of the NS1$^{th}$ page is completed at Step S208, the flow goes to Step SB, and when the supply of any other page is completed, the flow goes to Step SF.

(SB) If the paper sensor 141 has detected an original, the flow goes to Step SC, and if not, the flow goes to Step SF since the staple processing is to be executed.

(SC) If NX<NS0 regarding the reading of the originals, the flow returns to Step SB. This is intended to wait for one of the following situations to occur: a situation where NX=NS0 holds in a state where the original exists; and a situation where no original is left before NX=NS0 holds. If NX<NS0 does not hold, that is, if the original exists and NX=NS0 holds, the flow goes to Step SD. This is intended to discharge a bundle of copies without any staple processing.

In the third example, in the case where an original exists and NX=NS0 holds, it is determined that NX>NS0 holds.

(SD) After an image of the NS1$^{th}$ page is formed by the print engine 15, this copy is discharged from the copier 10. Next, a command for discharging the bundle of the copies is supplied to the controller 25 this time. At the same time, 0 is substituted in M. This is intended to supply the controller 25 with the discharge command every time copies corresponding to the set number NS1 are carried onto the stacker 26.

The controller 25 responds to the discharge command by interruption processing to set the discharge flag F in the storage unit 28.

Incidentally, it is also acceptable that the discharge command is immediately supplied to the controller 25 and the controller 25 receiving the discharge command executes the command not immediately but after a predetermined time passes.

(SE) After the controller 25 notifies that the discharge of the bundle of the copies has been completed, the flow goes to Step SF.

(SF) If there is any more data to be supplied to the print engine 15, the flow returns to Step S208, and if not, the threads of Steps S207 to S209 and SA to SF are finished.

In a case where the staple processing is selected, the print controller 12 supplies a start command to the controller 25 when the processing at Step S208 is completed for the first page. In response to the start command, the controller 25 starts processing shown in FIG. 9.

(S210) Since the total number of image formed papers Nm in one copy job is unknown, an arbitrary value Nmax which is larger than the number of sheets on which images are formable, for example, 1000 is substituted in Nm. This total number of image formed papers Nm is updated later at Step S204.

(S211) An initial value 0 is substituted in a count i of the number of stacked papers.

(S212) The detection of a rear end portion of a paper by the paper sensor 24 is waited for.

(S213) i is incremented by 1.

(S214) If i=Nm, the flow goes to Step S219, and if not, the flow goes to Step S215.

(S215) If i=NS1, the flow goes to Step S216, and if not, the flow returns to Step S212.

(S216) If the discharge flag F is set, the flow goes to Step S217, and if not, the flow returns to Step S212.

(S217) After a set time passes, the belt conveyor 260 is driven to raise the bundle of the copies and the copies are discharged onto the tray 231. Then, the lift device 29 is driven to move down the tray 231 according to the thickness of the bundle of the copies. The aforesaid set time is a time long enough for a copy carried in from the copier 10 to reach the stacker 26 and to be surely held there.

Next, the belt conveyor 260 is returned to the initial state and at the same time, the completion of the discharge of the bundle of the copies is notified to the controller 12.

(S218) The number of remaining copies (Nm−1) is substituted in Nm, and the flow returns to Step S211.

(S219) If the discharge flag F is set, the flow goes to Step S221, and if not, the flow goes to Step S220.

(S220) After a set time passes, the bundle of the copies held by the stacker 26 is bound by the stapler 27. The set time here is a time long enough for a copy to reach the stacker 26 after a rear end portion of the copy is detected by the sensor 24 and to be surely held there.

(S221) The belt conveyor 260 is driven to raise the bundle of the copies and the bundle is discharged onto the tray 231. Further, the lift device 29 is driven to move down the tray 231 according to the thickness of the bundle.

Figure 10A:
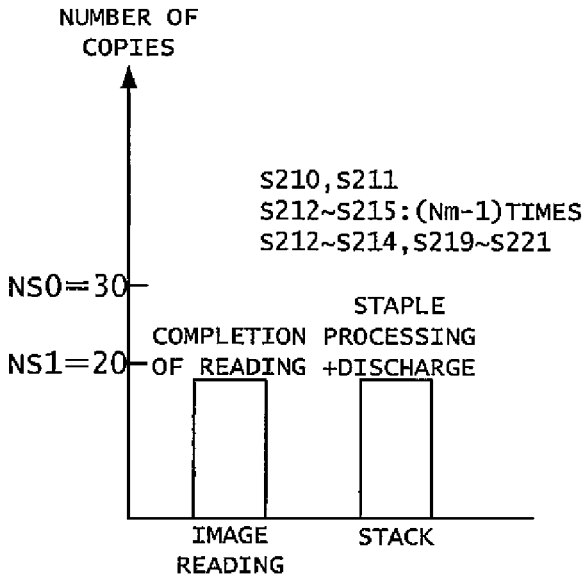
FIG. 10A and FIG. 10B are graphs showing concrete examples in a case where Nm≦NS0 and the staple processing is executed.
Figure 10B:
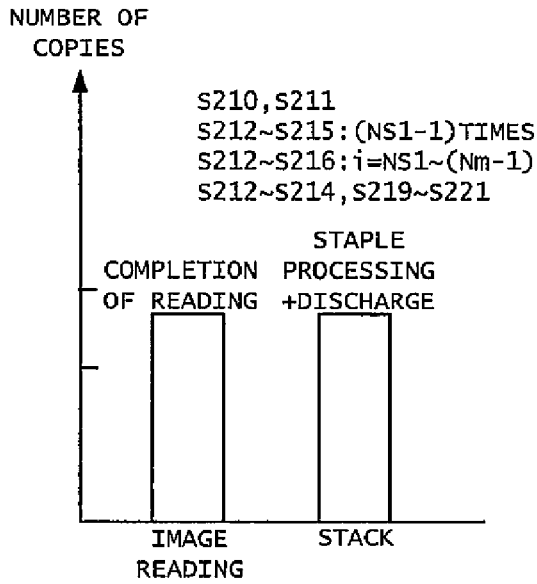
Figure 10C:
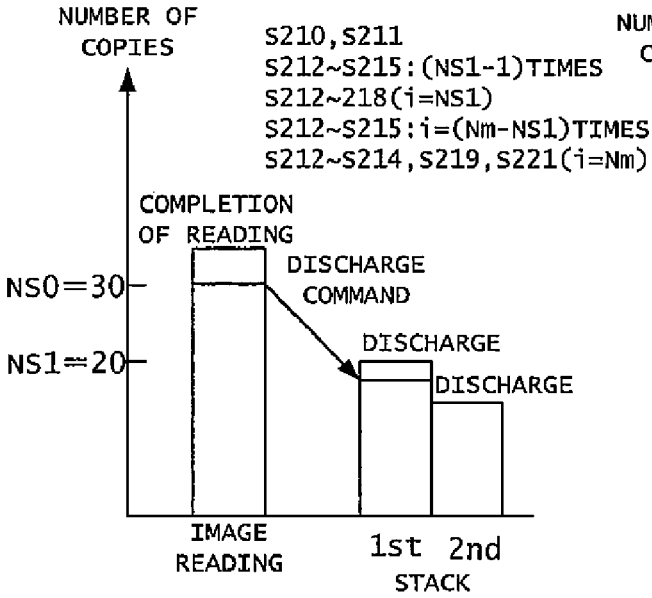
FIG. 10C and FIG. 10D are graphs showing concrete examples in a case where Nm>NS0 and the staple processing is not executed.
Figure 10D:
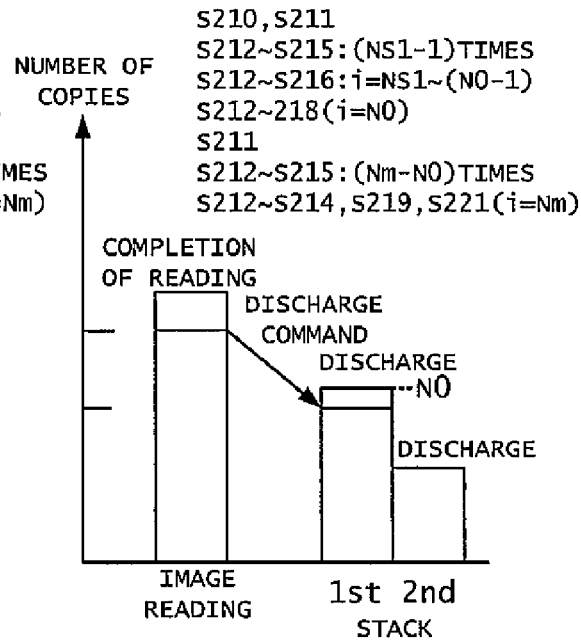

FIG. 10A to FIG. 10D show concrete examples of the above-described processing in a case where the staple processing is selected. FIG. 10A and FIG. 10B both show cases where Nm≦NS0 and the staple processing is executed. FIG. 10C and FIG. 10D both show cases where Nm>NS0 and the staple processing is not executed.

Figure 9:
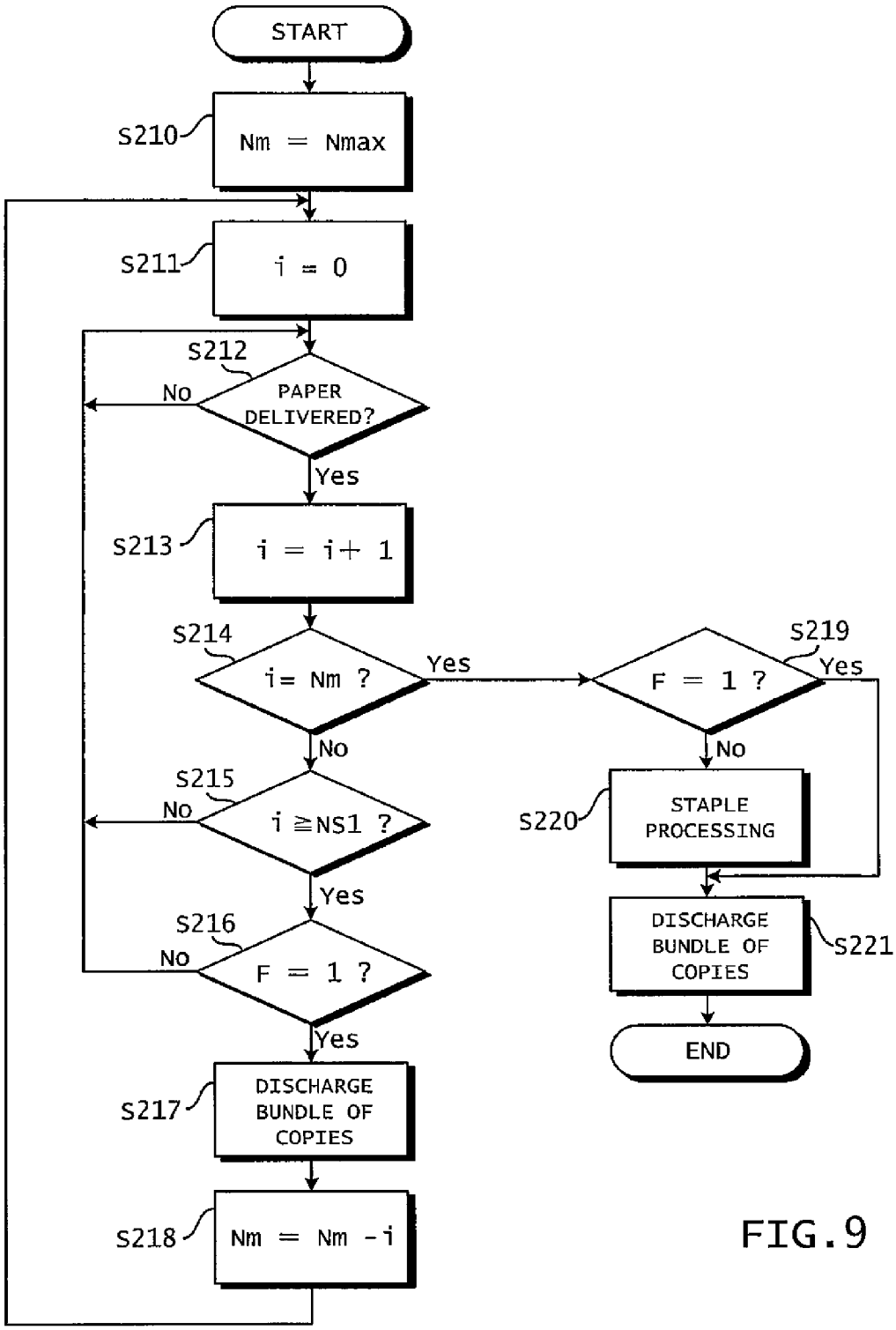
FIG. 9 is a flowchart showing processing executed by the controller of the finisher according to the copy processing of the third example.

FIG. 10A shows a case where Nm<NS1, and in this case, the processing in FIG. 9 is executed in the following sequence.

(1) S210 and S211 are executed.

(2) S212 to S215 are repeatedly executed (Nm−1) times.

(3) S212 to S214 and S219 to S221 are executed.

FIG. 10B shows a case where NS1<Nm<NS0, and in this case, the processing in FIG. 9 is executed in the following sequence.

(1) S210 and S211 are executed.

(2) S212 to S215 are repeatedly executed (NS1−1) times.

(3) S212 to S216 are executed for i=NS1 to (Nm−1).

(4) S212 to S214 and S219 to S221 are executed.

FIG. 10C shows a case where NS0<Nm<2NS1 and the controller 12 of the copier 10 determines that Nm>NS0 before NS1 sheets of copies are stacked on the stacker 26. In this case, the processing in FIG. 9 is executed in the following sequence.

(1) S210 and S211 are executed.

(2) S212 to S215 are repeatedly executed (NS1−1) times.

(3) S212 to S218 are executed for i=NS1: A bundle of NS1 sheets of copies is discharged without being stapled.

(4) S212 to S215 are repeatedly executed (Nm−NS1) times.

(5) S212 to S214, S219, and S221 are executed for i=Nm: A bundle of remaining NS1 sheets of copies or less is discharged without being stapled.

FIG. 10D shows a case where NS0<Nm<2NS1 and the controller 12 of the copier 10 determines that Nm>NS0 in a state where N0 sheets (NS1<N0<NS0) of copies are stacked on the stacker 26. In this case, the processing in FIG. 9 is executed in the following sequence.

(1) S210 and S211 are executed.

(2) S212 to S215 are repeatedly executed (NS1−1) times.

(3) S212 to S216 are executed for i=NS1 to (N0−1).

(4) S212 to S218 are executed for i=N0: A bundle of N0 sheets of copies are discharged without being stapled.

(5) S211 is executed.

(6) S212 to S215 are repeatedly executed (Nm−N0) times.

(7) S212 to S214, S219, and S221 are executed for i=Nm: A bundle of remaining NS1 sheets of copies or less is discharged without being stapled.

Figure 11A:
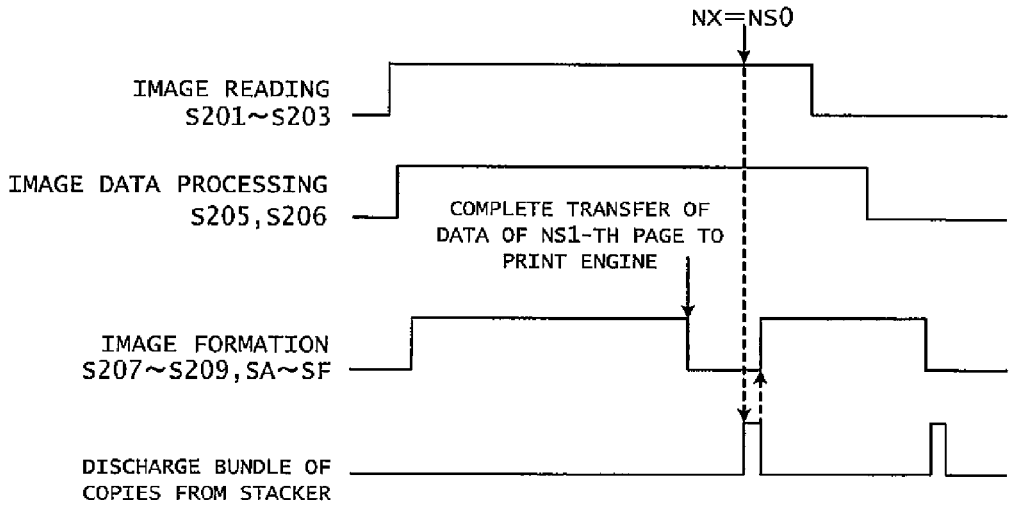
FIG. 11A and FIG. 11B are time charts showing concrete examples of the processing in FIG. 8 and the processing in FIG. 9 in a case where the staple processing is selected prior to the start of a job and Nm>NS0.
Figure 11B:
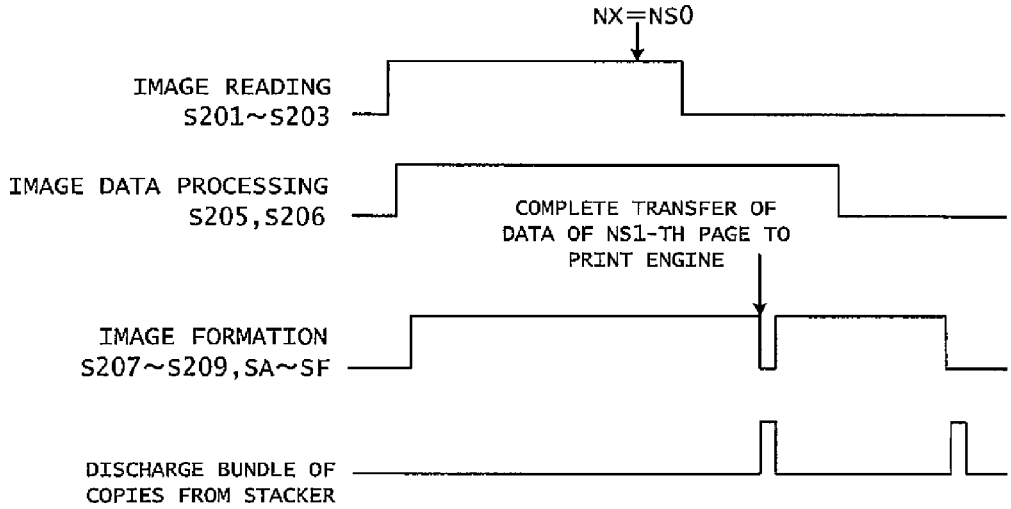

FIG. 11A and FIG. 11B are time charts showing concrete examples of the processing in FIG. 8 and the processing in FIG. 9 in a case where the staple processing is selected prior to the start of a job and the total number of image formed papers Nm>the upper limit number of sheets NS0.

FIG. 11A shows a case where NX<NS0 at the time when the supply of processed image data of the NS1$^{th}$ page to the print engine 15 is completed. In this case, the processing at Step SB and the processing at Step SC are repeated until NX=NS0 holds. Next, the discharge command is supplied to the controller 25 at Step SD. Thereafter, the flow returns from Step SF to Step SC after the controller 25 notifies that the discharge of a bundle of copies is completed.

FIG. 11B shows a case where NX>NS0 at the time when the supply of processed image data of the NS1$^{th}$ page to the print engine 15 is completed. In this case, the flow goes from Step SB directly to Step SD and the discharge command is supplied to the controller 25. Thereafter, the flow returns from Step SF to Step SC after the controller 25 notifies that the discharge of a bundle of copies is completed.

According to the third example described above, in a job in which the staple processing is selected, the number of pages N (or NX) whose image data are to be processed by the print controller 12 and the number of pages M on which images are to be formed by the print engine 15 are counted, and in the case where it is determined that the number of pages M becomes equal to the set number NS1, the image forming processing by the print engine 15 is suspended. Further, in a case where it is determined that the number of pages N (or NX) exceeds the upper limit number NS0, a bundle of copies is discharged onto the tray 231 without being stapled, and subsequently, the suspended image forming processing is resumed, which brings about an effect of almost completely eliminating the occurrence of a jam at the time when a bundle of copies is discharged from the stacker 26 without being stapled and contributes to improvement of reliability of the image forming system Further, owing to this effect, it is possible to increase the upper limit number NS0 than ever.

Further, since the image forming processing can be continued up to the set number NS1 without any pause, the response time of an image forming job can be shortened.

The above-described third example can be modified as follows.

For example, the counting at Step 203 in FIG. 8 is arbitrary, and instead of this counting, the number of pages whose images are processed at Step S205 or the number of pages whose image data are supplied at Step S208 may be counted. However, in a case where such a modification is made, it is as a matter of course that N should be used instead of the aforesaid NX when the number of pages N after the integration processing such as 4-in-1 is counted.

Further, the structure may be simplified in such a manner that a staple command is supplied to the controller 12 if NX≦NS0 and, if not, the discharge command is supplied to the controller 12, thereby making it possible to execute the processing in FIG. 8 without using the variable i. That is, the controller 25 may be structured to perform the staple processing and the operation of discharging a bundle of copies in response to the staple command when receiving the staple command, and to perform the operation of discharging a bundle of copies in response to the discharge command when receiving the discharge command.

Further, since the print controller 12 and the controller 25 are coupled to each other so as to be capable of mutual information transmission, the upper limit number NS0 and the set number NS1 only need be stored in one of the storage unit 28 and the storage unit 13.

All of the first, second, and third examples may be structured such that the controller 25 and the storage unit 28 are not provided and the print controller 12 controls the finisher 20. Further, it goes without saying that the finisher 20 may be built in the copier 10.

What is claimed is:

1. An image forming apparatus comprising:

a print engine which forms an image based on image data processed in a unit of page and prints the image on a paper; and a controller which, in a case where it is requested in a given print job that printed papers be sent to a finisher to be stapled with a stapler in the finisher, counts the number of pages of image data that are intended to be printed on papers in the current print job, concurrently with an operation for said print engine to actually print images on papers based on image data processed for said print engine, and when determining that a count value of the pages exceeds an upper limit number of printed papers that are staplable with the stapler, gives to the finisher a command that the received printed papers should be discharged without being stapled, at a stage when the processing of the image data in number exceeding the upper limit number is finished and the number of the printed papers actually sent to the finisher is fess than the count value, thereby making the number of the printed papers discharged without being stapled by the finisher smaller than the upper limit number.

2. The image forming apparatus according to claim 1, wherein said controller further has, as a post-stage count value, a value of the counted number of the printed papers sent to the finisher, and in a case where the pre-stage count value is determined as exceeding the upper limit number, said controller executes the following controls:

(a) when the post-stage count value exceeds a set number having a value smaller than a value of the upper limit number, said controller gives the finisher a command that a bundle of the printed papers already received by the finisher should be discharged to a tray; and (b) when, on the other hand, the post-stage count value does not exceed the set number, said controller gives the finisher a command that the bundle of the printed papers received by the finisher should be discharged to the tray after the post-stage count value reaches the set number.

3. The image forming apparatus according to claim 1, wherein said controller executes the following controls:

when there is any more printed paper to be sent to the finisher at an instant when the execution of the control of (b) is completed, said controller newly counts the post-stage count value from the instant of the completion, and executes the control of (b) again when a value of the newly counted number exceeds the upper limit number; and when the sending of the printed papers to the finisher is finished before the post-stage count value reaches the set number during the execution of the control of (b), said controller gives the finisher a command that a bundle of the printed papers already received by the finisher should be discharged to the tray.

* * * * *